United States Patent [19]

Remond

[11] 4,294,028

[45] Oct. 13, 1981

[54] SUSPENSION-TYPE FILE FOLDER

[75] Inventor: Jean R. A. Reymond, Grenoble, France

[73] Assignee: Etablissements F. Nicollet & Cie Societe Anonyme, Echirolle, France

[21] Appl. No.: 110,800

[22] Filed: Jan. 9, 1980

[30] Foreign Application Priority Data

Jan. 11, 1979 [FR] France ..... 79 01181

[51] Int. Cl.[3] ..... B42F 21/00; A47B 63/00; B42F 15/00

[52] U.S. Cl. ..... 40/359; 312/184

[58] Field of Search ..... 40/359, 10 R; 312/184

[56] References Cited

U.S. PATENT DOCUMENTS

| | | | |
|---|---|---|---|
| 1,481,173 | 1/1924 | Wright | 40/359 |
| 2,623,311 | 12/1952 | Condon | 40/359 |
| 4,031,646 | 6/1977 | de Nouël | 40/359 |
| 4,209,925 | 7/1980 | Brügman | 40/359 |
| 4,232,596 | 11/1980 | Kroll et al. | 312/184 |

*Primary Examiner*—G. E. McNeill
*Assistant Examiner*—Michael J. Foycik, Jr.
*Attorney, Agent, or Firm*—Karl F. Ross

[57] ABSTRACT

A suspension-type file folder is provided with an indicia tab molded unitarily with a plate or wing securing the tubular label-receiving window to a leaf of the file folder. The plate is molded unitarily with a pincer engageable with a male member of the adjacent leaf of the next folder to interconnect the file folders and prevent insertion of articles between them.

5 Claims, 6 Drawing Figures

SUSPENSION-TYPE FILE FOLDER

FIELD OF THE INVENTION

My present invention realtes to suspension-type file folders and, more particularly, to such file folders which are provided with means for interconnecting successive folders in a file cabinet, drawer or the like.

BACKGROUND OF THE INVENTION

Suspension-type file folders generally comprise a pair of leaves hinged together at their bottom, e.g. at a fold, and are provided at their upper edges with laterally extending hooks adapted to overhang and rest upon rails in a file drawer or cabinet. The hooks of each leaf may be unitary with a metallic strip or bar running the full length of the upper edge of the leaf.

The file folders are commonly formed of cardboard, paperboard or like relatively stiff material and can be provided along a horizontal upper edge or a vertical lateral edge with indicia representing the contents of the file, its classification or order in a system of classification, or like means readable by the user.

For example, an indicating tab can be mounted on the file folder and can form, or be formed with a transparent window into which an identifying label can be removably inserted.

It is also known to provide such suspension file folders with means, associated with the indicating tab or otherwise, for connecting successive files together, e.g. by providing one leaf of one folder with a male member and the proximal leaf of the next folder with a female member, the two members mating to interconnect the folders and form an accordion-like arrangement from a multiplicity of folders thereby preventing the introduction of documents or other articles between successive folders.

In general, there are two types of connections which are used in association with the indicating tab or can be considered connected or part thereof for the purposes of interconnecting successive folders.

The first of these arrangements makes use of a tab formed with lips directed rearwardly and forming a seat engageable with an edge of the proximal leaf of the next file.

The second and more common connecting arrangement is of a snap fastener or pushbutton type in which the male members are fixed on one edge of the file folder, while the female members are rigid with the indicating tab fixed on the corresponding edge of the next file.

This second type has predominated in the past because its use is more convenient, the system is relatively compact and neat, and mounting and dismounting an assembly of files in a given classification system is facilitated.

However, notwithstanding the significant advantages of this arrangement, there are certain disadvantages.

For example, the indexing or identifying tab must be composed of two different materials, at least insofar as the present developments of synthetic resins are concerned. The sheath or window containing the replaceable label usually must be highly transparent, a characteristic readily attainable with the somewhat more rigid synthetic resins, while the female member must be composed of a material capable of a high degree of resilient flexure, which is a characteristic usually not present in the synthetic resins having a high degree of transparency.

Thus the parts which are required to be more supple and flexible are customarily made from synthetic resin materials quite different from those forming the transparent element or window of the tab.

Not only does this increase the cost of manufacture and complicate fabrication, but it also creates problems with respect to structural integrity and mounting upon the file folder.

OBJECTS OF THE INVENTION

It is, therefore, the principal object of the present invention to provide a suspension-file folder in which these disadvantages are obviated.

Another object of the invention is to provide an improved suspension-type file folder in which the means for interconnecting successive file folders can be made unitary with the means forming the indicia display window, all composed of a single material and in one piece.

SUMMARY OF THE INVENTION

These objects, and others which will become apparent hereinafter, are attained, in accordance with the present invention, in a suspension-file folder which comprises a pair of hingedly interconnecting leaves formed, in the usual manner, with suspender rods along their upper edges having outwardly projecting hooks adapted to rest upon respective rails or bars of the suspension file.

According to the invention each folder is provided with an indicating tab molded in a single piece from a synthetic resin material and constituted with an elongated window-forming sheath or tube which is transparent and can receive a replaceable label, card or strip pertinent to the contents of the folder or a classification of the contents.

According to the invention, the tubular window is formed unitarily and by molding with a plate or wing formed with means for connecting the folder with a neighboring folder, the latter means including a gripper having a pair of arms forming a pincer arrangement and deflectable in a plane parallel to the plane of the plate and formed unitarily with the latter.

According to an important feature of the invention, the plate is provided with an opening in the region of these arms and registering with them, the two arms being capable of elastic displacement which is limited by means formed on the plate, e.g. the opposite edges of the opening and/or a pair of pins flanking this opening and formed unitarily with the plate.

The arms, in turn, are concave toward one another to form a seat in which a male member of an adjacent file folder can be inserted, the seat forming the female member of the connecting means.

BRIEF DESCRIPTION OF THE DRAWING

The above and other objects, features and advantages of the present invention will become more readily apparent from the following description, reference being made to the accompanying drawing, in which.

SPECIFIC DESCRIPTION

Figure 1:
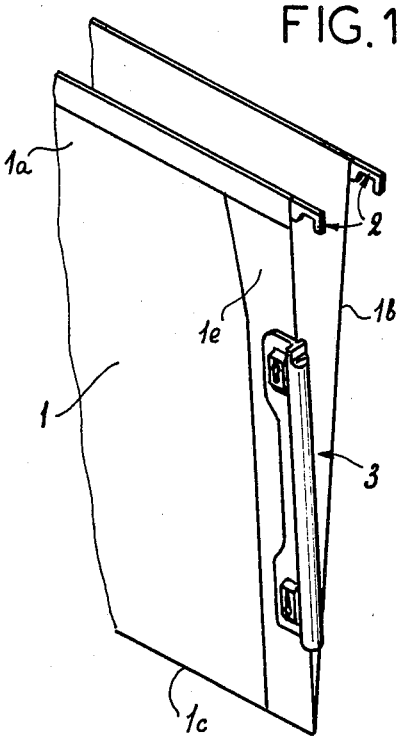
FIGS. 1 and 2 are perspective views diagrammatically illustrating file folders according to the present invention formed with the improved tab along a vertical edge and a horizontal edge, respectively.
Figure 2:
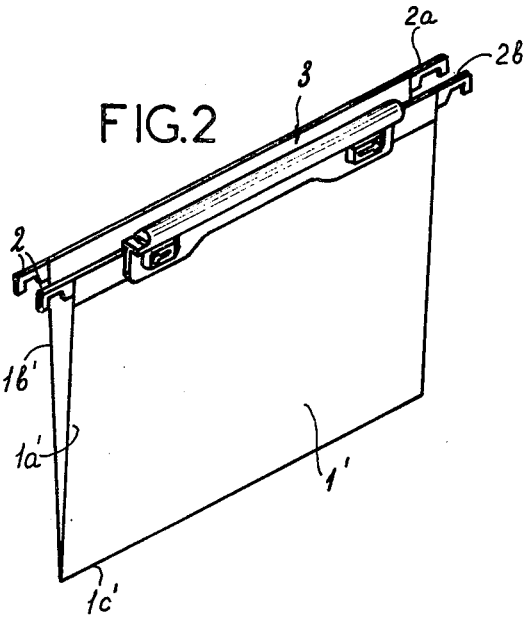
Figure 4:
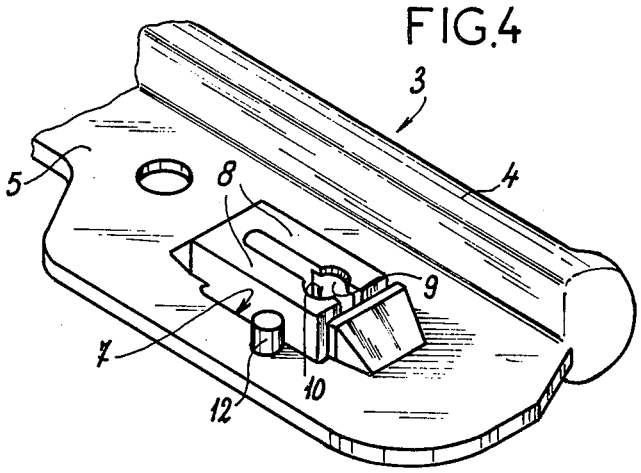
FIG. 4 is an enlarged perspective view of a portion of the tab showing one of the female connecting members, the tab being broken away and in diagrammatic form.

FIGS. 1 and 2 show files of the suspension type according to this invention, the files being represented at 1 and 1', respectively, each defined between a pair of leaves 1*a*, 1*b* and 1*a*', 1*b*', hinged together at their bottoms 1*c* and 1*e*. These file covers or jackets can be composed of cardboard, paperboard or some other material having a certain degree of rigidity and strength. The hinge portion 1*c*, 1*c*' may be constituted by a fold in the material so that a crevice is provided between the leaves into which documents and the like can be inserted.

In the usual manner, suspension rods 2 are provided along the upper edges, the rods having hooks 2*a*, 2*b* projecting beyond the vertical lateral edges for engagement upon rails of a suspension-file drawer, rack, cabinet or box.

The hooks 2*a* and 2*b* permit the folders to slide along the rails and to be spread to receive documents and the like.

In addition, the file folder 1 is provided with an indicating tab 3 along a vertical edge of one of the leaves which can be reinforced by a laminated coating of synthetic resin material. The file folder 1' is provided with a tab 3 along one of its upper edges.

The tab 3 serves both to receive a label or other indication of the contents of the folder and as part of the means for connecting the folder with an adjacent folder in the suspension file. The tabs 3 have been shown in greater detail in FIGS. 3 through 6.

The tab 3 of the present invention is molded in a single piece of a synthetic resin which is transparent so that the label or card can be viewed through the sheath or tubular portion receiving same.

Although the tab of the invention is formed in a single molded body, it comprises an elongated tube or sheath 4 into the interior 4' of which the label can be inserted in the direction of arrow 4*a*.

Molded unitarily with the tubular portion 4 is a wing or plate 5 which allows the tab to be fixed to the folder on the one hand and, on the other, to provide the means for connecting adjacent folders together.

Attachment of the tab 3 to the file folder is effected by passing the fingers 6, molded unitarily with the plate 5 through holes previously punched in the folder and by spreading the free end of this finger to retain the tab thereon.

The lateral connection of each folder to the next is effected by a pushbutton or snap-type connection, the female part of the fastener being formed unitarily on the plate 5. This is facilitated, notwithstanding the fact that the transparent material from which the tab is molded, is relatively rigid and not at all supple or flexible in the usual sense.

According to the invention, a pincer-type grip is molded unitarily with the plate close to each end thereof.

Thus, close to each end, the plate 5 is formed with a generally rectangular opening 7 into which two arms 8 of the grip or pincer extend, the arms being unitary with one another and the plate at one end thereof.

The arms 8 are of a thickness greater than that of the plate and are formed along their juxtaposed faces with recessed parts 9 of cylindrical configuration so that together the two recesses form a seat of generally cylindrical shape in which a male projection 11 from an adjoining file folder can be received. A pair of leaves 10 along the outer edges of these recesses overhang the projection 11 and limit retraction thereof.

Figure 6:
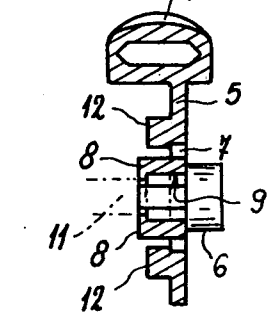
FIG. 6 is a cross-sectional view taken along the line VI—VI of FIG. 3.

The seat 9, 10 and the arms 8 thus form a female member of a snap fastener cooperating with the male member 11 which has been shown in dot-dash lines in FIG. 6 and is provided on an edge of an adjacent file folder corresponding to the edge upon which the tab is formed, but on the other leaf from that bearing the tab.

Figure 3:
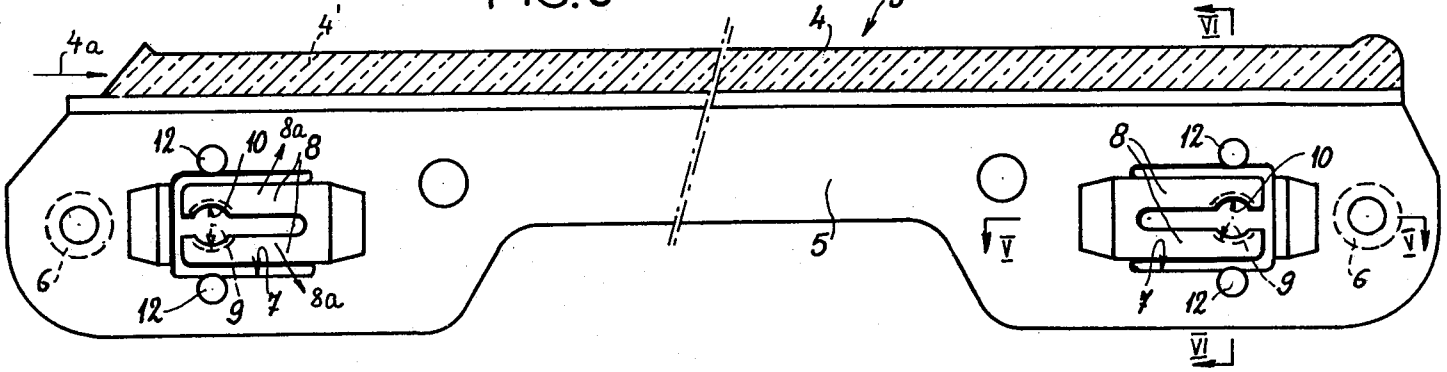
FIG. 3 is an elevational view drawn to a substantially larger scale than FIGS. 1 and 2 showing a tab according to the invention.
Figure 5:
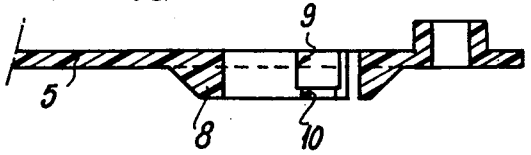
FIG. 5 is a cross-sectional view taken along the line V—V of FIG. 3.

Since the two arms can be spread in the direction of arrows 8*a* parallel to the plane of the plate 5 and hence parallel to the plane of the base in FIG. 3, the necessary resilient deformation can be effected in spite of the fact that the material from which the tab is constituted is a relatively rigid synthetic resin as usually is required if it is to be transparent.

Naturally, because of the rigidity and relative inflexibility of the synthetic resin material, the arms 8 should have only limited spreadability and to this end a pair of pins 12 can be provided to flank the opening 7 and limit the movement of the arms in the direction of arrows 8*a*.

The pins 12, of course, are also molded unitarily with the plate.

Naturally, modifications can be made in the shape of the sheath 4 and in other elements of the tab within the scope of the instant claims and without departing from the spirit of the invention. Any transparent synthetic resins, such as a polyacrylate, can be used in fabricating the tab.

I claim:

1. A suspension-file folder comprising:

a pair of leaves hingedly interconnected at their bottoms and formed with a pair of horizontal edges and a pair of vertical edges;

suspension rods formed along the upper edges of said leaves and having laterally projecting formations adapted to suspend the folder from a pair of rails; and an indicating tab fixed to one of said leaves along one of said edges, said indicating tab being molded in a single piece from a transparent synthetic resin material and comprising:

an elongated tubular portion extending along said one of said edges and adapted to receive an identifying label for said folder, a plate formed unitarily with said tubular portion and overlying a face of one of said leaves, said plate being provided with at least one opening, and a pair of arms disposed in said opening and molded unitarily with said plate at one end of each arm while having free ends disposed in said opening and deflectable in planes parallel to said plate, said free ends of said arms being formed with mutually confronting recesses forming a seat for a male member carried by an adjacent folder whereby said arms form a pincer defining a female member for connecting folders together.

2. The suspension-file folder defined in claim 1 wherein said plate is elongated and extends longitudinally along said one of said edges, a respective such opening being formed proximal to each end of said plate and being provided with a respective pair of arms forming a respective pincer.

3. The suspension-file folder defined in claim 1 or claim 2 wherein said recesses are generally cylindrical.

4. The suspension-file folder defined in claim 3 wherein said recesses are delimited outwardly by respective arcuate ridges with radii of curvature less than the radius of a cylinder defined by said recesses.

5. The suspension-file folder defined in claim 4, further comprising a pair of abutments flanking said opening and limiting the relative outward displacement of the free ends of the respective arms, said abutments being molded unitarily with said plate.

* * * * *